US006847794B2

(12) United States Patent
Namura

(10) Patent No.: US 6,847,794 B2
(45) Date of Patent: Jan. 25, 2005

(54) IMAGE FORMING DEVICE

(75) Inventor: Osamu Namura, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/383,258

(22) Filed: Mar. 7, 2003

(65) Prior Publication Data

US 2004/0175200 A1 Sep. 9, 2004

(51) Int. Cl.[7] ..... G03G 15/00
(52) U.S. Cl. ..... 399/88; 399/37
(58) Field of Search ..... 399/88, 75, 76, 399/77, 9, 36, 37, 38; 307/125

(56) References Cited

U.S. PATENT DOCUMENTS 5,546,161 A * 8/1996 Sakai et al. ..... 399/88 X
5,587,799 A * 12/1996 Kawamura et al. ..... 358/296
6,134,401 A * 10/2000 Yun et al. ..... 399/37 X
6,226,472 B1 * 5/2001 Yun ..... 399/88 X
6,330,069 B1 * 12/2001 Kim ..... 399/88 X

FOREIGN PATENT DOCUMENTS

JP 03-143225 * 6/1991
JP 2001-061027 A 3/2001

* cited by examiner

*Primary Examiner*—Sophia S. Chen
(74) *Attorney, Agent, or Firm*—Foley & Lardner LLP

(57) ABSTRACT

An image forming device according to the present invention has an architecture including a control unit producing power-on and power-off signals to control individual power supply to functional units activated by supplied power, the power-on signal being an instruction to apply electric power to the functional units while the power-off signal is an instruction to interrupt power supply to the functional units; and a power supply unit adapted to supply each functional unit with electric power upon receiving the power-on signal and interrupt power supply to each functional unit upon receiving the power-off signal.

7 Claims, 10 Drawing Sheets

IMAGE FORMING DEVICE

BACKGROUND OF THE INVENTION

The present invention relates to an image forming device such as a copying machine, a scanner, a printer, and a versatile all-in-one machine having various features of them.

As has already been disclosed in a prior art document like Japanese Unexamined Patent Publication 2000-61027, an electrical device and a communication terminal device, which are characterized by an energy saving feature, are usually provided with two power sources, namely, a primary power source used during a normal mode operation and a, secondary power source used during an energy saving mode operation. The latter energy saving power source supplies electric power to functional units, such as an operation unit and a call signal detection unit, which require a certain minimum amount of power during standby.

Configured with two power sources as mentioned above, however, those devices still consume an amount of power that is not negligible. For instance, in the aforementioned devices, functional units therein are supplied with power all at once from the primary power source when the current operation mode is switched from energy saving mode to normal mode. This means that some standby units that are currently not used are supplied with power.

SUMMARY OF THE INVENTION

Accordingly, it is an object of the present invention to provide an image forming device that attains reduced power consumption.

An image forming device according to the present invention comprises an architecture comprised of a control unit producing power-on and power-off signals to control individual power supply to functional units activated by supplied power, the power-on signal being an instruction to apply electric power to the functional units while the power-off signal is an instruction to interrupt power supply to the functional units; and a power supply unit adapted to supply each functional unit with electric power upon receiving the power-on signal and interrupt power supply to each functional unit upon receiving the power-off signal.

DETAILED DESCRIPTION OF THE INVENTION

Figure 1:
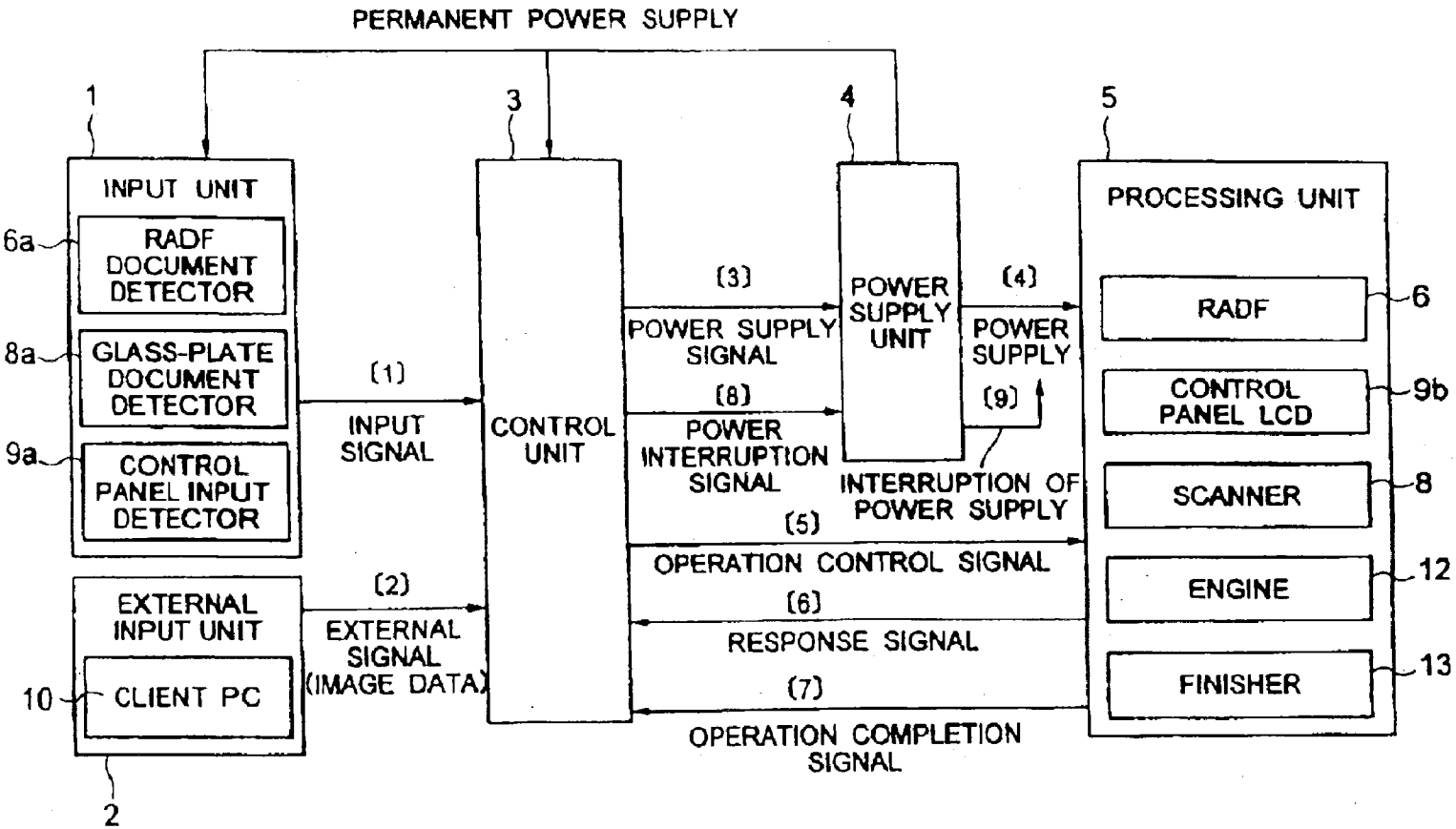
FIG. 1 is a block diagram showing a system architecture of the control system of an exemplary image forming device according to the present invention.

FIG. 1 is a block diagram showing a system architecture of the control system of a preferred embodiment of an image forming device according to the present invention.

The control system is designed to provide adequate control over power supply from a power supply unit 4 as a power source to a processing unit 5 in such a manner that power supply to the processing unit 5 is performed only when required, thereby effecting a reduction of power consumption.

The control system includes an input unit 1 enabling entries of various information, an external input unit 2 taking external image data in to transfer them to the control system, a control unit 3 giving adequate control over the whole control system, a power supply unit 4 applying electric power to functional units, and an execution unit (processing unit) 5 activated with power from the power supply unit 4 to execute an instruction from the control unit 3. These units will be described in more details below.

The input unit 1 determines that a user has set an original document in position and detects other various settings by the user. More specifically, the input unit 1 includes a RADF (recirculating automatic document feeder) 6, and a component of the same, or a RADF document detector 6*a* determines if the original document is placed in position on the RADF 6. The input unit 1 also has a scanner 8 described later, and a component of the same, or a glass-plate document detector 8*a* determines if the original document is placed in position on a glass plate (not shown). The input unit 1 additionally has a control panel described later, and a component of the same, or a control-panel entry detector 9*a* detects entries of various settings by the user. The entries of the settings include, for example, a choice of a copying machine mode or a scanner mode, options of features with finishers such as a stapler and a shifter. A touch of the user to the control panel for various settings stimulates the external input unit 2 to recognize the entered information as input signals and transfer them to the control unit 3.

The external input unit 2 takes in a variety of external image data and transfers them to the control system. One example of the external input unit 2 is a client PC (personal computer) 10. The control system, when receiving the imaged data, serves under e.g. the printer mode.

The control unit 3 provides controls over an operation of the processing unit 5 and a power supply to the same. Particulars of this will be as follows: The control unit 3 produces an operation control signal (actuation signal) to give an instruction to the processing unit 5 to start an operation. An operation control signal contains specific operation information for the processing unit, such as information if the finisher 13 is to use a stapler function. Also, the control unit 3 gives a command to the power supply unit 4 to supply the processing unit 5 with power or interrupt power supply. Specifically, the control unit 3 produces power control signals (i.e., a power supply signal and a power interruption signal) to give a command to apply electrical power or interrupt power supply to component units of the processing unit 5 (e.g., RADF6, control panel LCD 9*b*, scanner 8, engine 12, and finisher 13). Then, the control unit 3 sends the produced power supply signal (power-on signal) and power interruption signal (power-off signal) to the power supply unit 4.

The power supply unit 4 serves to apply power to the processing unit 5 and interrupt power supply to the processing unit 5, depending upon the received power supply signal and power interruption signal. Thus, the power supply unit 4 is designed to enable individual power supply to each components of the processing unit 5. On the other hand, the power supply unit 4 permanently supplies electric power to the input unit and the control unit 3 without intermission.

The processing unit 5 utilizes supplied power from the power supply unit 4 and executes an instruction (operation control signal) from the control unit 3. The processing unit 5 has its operation state (e.g., information that a task has been completed) fed back to the control unit 3. For that purpose, the processing unit 5 is comprised of components such as the RADF 6 serving to feed original documents onto the glass plane one after another, and the control panel LCD 9 aiding the user in visually recognizing the settings entered on the control panel and/or a current operation state of the device (e.g., it is copying) which are graphically represented. The processing unit 5 also includes the scanner 8 used to read data from the original document set on the glass plate to generate image data. The scanner 8 stores the generated image data in a memory not shown. The processing unit 5 has the engine 12 that uses the image data stored in the memory to reproduce a visible image on a sheet with toner or other agents. The processing unit also includes the engine 13 serving as a stapler or a shifter, and the finisher 13 is provided with a plurality of trays (not shown) that receives evacuated sheets.

Arrows in FIG. 1 indicate directions of signal transfer, and supply and interruption of electric-power. In this embodiment, a response signal [6] is transmitted only from the engine 12 as shown in FIG. 1 but not from any other component of the processing unit 5.

An operation of the control system configured as stated above will now be described.

FIGS. 2 to 5 are flow charts illustrating stepwise operation of the control system.

Figure 2:
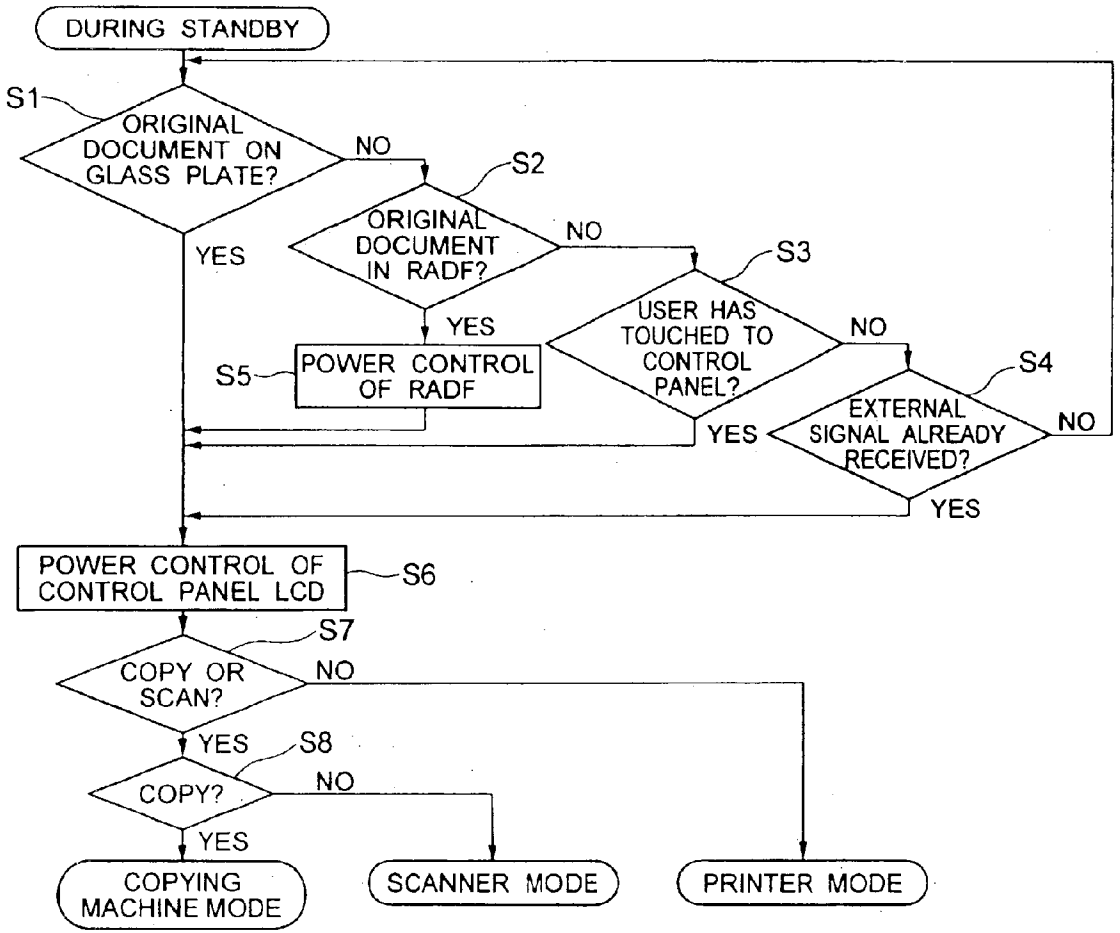
FIG. 2 is a flow chart illustrating stepwise operation of the control system.

First, as depicted in FIG. 2, the control unit 3, although currently in its standby state, is to receive an input signal from the input unit (i.e., any of the RADF document detector 6*a*, the glass-plate document detector 8*a*, and the control panel input detector 9*a*) as in [1] in FIG. 1 and determine the following matters: If an original document exists on the glass plate not shown (Step S1), if the original document exists in the RADF 6 (Step S2), and if the user has touched to the control panel (Step S3). Furthermore, the control unit 3 determines if image data (external signal) has been received from the external input unit 2 or client PC 10 ([2], Step S4).

The control unit 3, determining that the above-mentioned input signal or the external signal has been received, applies electric power to the control panel LCD 9*b* to light the control panel (Step S6). Thus, the control unit 3 sends the power supply signal to the power supply unit 4 ([3]), and the power supply unit 4, upon receiving the power supply signal, supplies the control panel LCD 9*b* with power ([4]). If it determines that the original document exists in the RADF 6 (step S2), however, the power supply unit 4 applies power to the RADF 6 prior to power supply to the control panel LCD 9*b* ([3], [4], Step S5).

Next, the control unit 3 determines which mode is to be first executed among the copying machine mode, the scanner mode, and the printer mode (Steps S7 and S8). Thus, when the control unit 3 receives the image data (external signal) from the external input unit 2 (i.e., YES at Step S4), a procedure (FIG. 5) under the printer mode is executed (i.e., NO at Step S7), or otherwise (i.e., YES at Step S7), the control unit 3 has the control panel urge the user to chose one of options, the copying machine mode or the scanner mode (Step S8). When the control unit 3 determines that the signal indicating the copying machine mode (containing information if some features of the finisher 13 are to be used) has been received from the control panel input detector 9*a* (i.e., YES at Step S8), a procedure under the copying machine mode (FIG. 3) is executed. On the contrary, when the control unit 3 determines that a signal indicating the scanner mode has been received (i.e., NO at Step S8), a procedure under the scanner mode (FIG. 4) is executed.

The procedures of the copying machine mode (FIG. 3), the scanner mode (FIG. 4), and the printer mode (FIG. 5) will now be described, respectively.

First described will be that of the copying machine mode.

Figure 3:
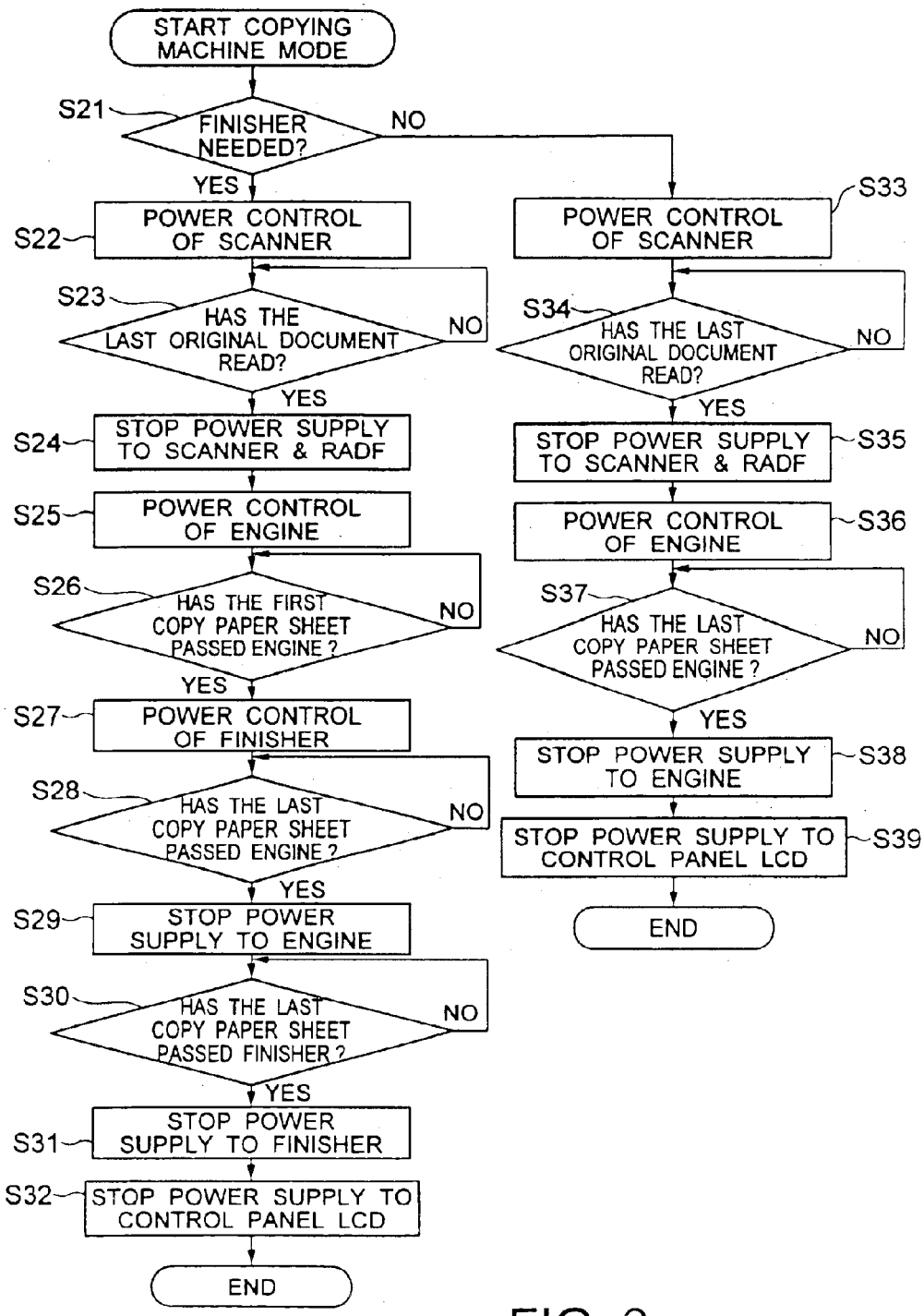
FIG. 3 is a flow chart illustrating succeeding steps (process of a copying machine mode) to those in FIG. 2.

FIG. 3 is a flow chart illustrating stepwise operation of the copying machine mode.

Above all, the control unit 3, which has had a choice of the copying machine mode depending upon the input signal from the control panel input detector 9*a*, further utilizes the same input signal to determine if some features of the finisher 13 are to be needed (Step S21).

When the control unit 3 determines that some features of the finisher 13 are to be used (i.e., YES at Step S21), steps S22 to S32 are executed.

Specifically, after the control unit 3 sends the power supply signal to the power supply unit 4 ([3]), the power supply unit 4, upon receiving the power supply signal, supplies the scanner 8 with power ([4], Step S22). Being synchronous with power supply from the power supply unit 4 to the scanner 8, the control unit 3 sends the operation control signal to the scanner 8 ([5], Step S22).

When it is supplied with power from the power supply unit 4 and receives the operation control signal from the control unit 3, the scanner 8 starts reading data in the original document set on the glass plate (Step S23). When more than one of the original documents are placed in position in the RADF 6 (see Step S5 in FIG. 2), the original documents are sequentially read while being sent onto the glass plate from the RADF 6. The scanner 8 stores the read image data in the memory not shown (Step S23).

When all the original documents have been thoroughly read (i.e., YES at Step S23), the scanner 8 sends an operation completion signal to the control unit 3 ([7], Step S24). The control unit 3, upon receiving the operation completion signal, sends the power interruption signal to the power supply unit 4, which in turn interrupts power supply to the scanner 8 ([9], Step S24). Without exception, the scanner 8 to which power supply is interrupted is to be deactivated. When the original documents are sent from the RADF 6 in data reading, the power supply unit 4 also interrupts power supply to the RADF 6 ([9], Step S24).

Then, as indicated in Step S25, the control unit 3, which has interrupted power supply to the scanner 8 (and to the RADF 6), sends the power supply signal to the power supply unit 4, which in turn supply the engine 12 with electric power ([4], Step S25). Being synchronous with power supply from the power supply unit 4 to the engine 12, the control unit 3 sends the operation control signal to the engine 12 ([5], Step S25).

The engine 12, after it is supplied with power from the power supply unit 4 and receives the operation control signal from the control unit 3, uses the image data in the memory to reproduce a visible image in a copy paper sheet (Step S26).

The engine 12, after reproducing the image on the first one of copy paper sheets, or, after passing the first copy paper sheet, sends the response signal to the control unit 3 to report that the first copy paper sheet has been passed ([6], Step S27). The control unit 3, upon receiving the response signal, sends the power supply signal to the power supply unit 4 ([3]), and the power supply unit 4 which has received the power supply signal supply the finisher 13 with electric power ([4], Step S27).

The finisher, upon being supplied with power from the power supply unit 4 and receiving the operation control signal from the control unit 3, receives from the engine 12 the copy paper sheet having the image reproduced therein, and starts its requested task (Step S27). When more than one sets of copies are needed, the processed copy paper sheets are sorted into the trays during evacuation (shifter function).

The engine 12, upon reproducing the image in the last one of the copy paper sheets (i.e., YES at Step S28), or after passing the last copy paper sheet, sends the operation completion signal to the control unit 3 ([7], Step S29). The control unit 3, upon receiving the operation completion signal, transmits the power interruption signal to the power supply unit 4 ([8]), and the power supply unit 4, upon receiving the power interruption signal, interrupts power supply to the engine 12 ([9], Step S29).

Additionally, the finisher 13, upon completing to finish the set(s) of the sheets from the engine 12 (i.e., YES at Step S30), or after passing the last one of the processed copy paper sheet, sends the operation completion signal to the control unit 3 ([7], Step S31). The control unit 3, upon receiving the operation completion signal, sends the power interruption signal to the power supply unit 4 ([8]), and the power supply unit 4, upon receiving the power interruption signal, interrupts power supply to the finisher 13 ([9], Step S31).

After that, the control unit 3 sends the power interruption signal to the power supply unit 4 ([8]), and the power supply unit 4, upon receiving the power interruption signal, interrupts power supply to the control panel LCD. 9*b* ([9], Step S32). This causes a light to go out from the control panel.

In this way, the procedure with the features of the finisher 13 under the copying machine mode (i.e., YES at Step S21) is terminated.

On the other hand, as for a procedure without the features of the finisher 13 under the copying machine mode (i.e., NO at Step S21), the similar power controls are carried out (Steps S33 to S39) except for the power control in relation with the finisher 13.

As indicated in Step S21 in FIG. 3, when it determines that any feature of the finisher 13 is needless (i.e., NO at Step S21), the control unit 3 sends the power supply signal to the power supply unit 4 ([3]), and the power supply unit 4, upon receiving the power supply signal, supply the scanner 8 with electric power ([4], Step S33). Being synchronous with power supply from the power supply unit 4 to the scanner 8, the control unit 3 sends the power control signal to the scanner ([5], Step S33).

The scanner a, upon being supplied with power from the power supply unit 4 and receiving the operation control signal from the control unit 3, starts reading the original document and then stores the read data in the memory (Step S34).

The scanner 8, upon reading all the original documents, sends the operation completion signal to the control unit 3 ([7]). The control unit 3, upon receiving the operation completion signal, sends the power interruption signal to the power supply unit 4 ([8]), and the power supply unit 4, upon receiving the power interruption signal, interrupts power supply to the scanner 8 ([9], Step S35). In reading the original documents sent from the RADF 6 (see Step S5 in FIG. 2), the power supply unit 4 also interrupts power supply to the RADF 6 ([9], Step S35).

The control unit 3, after breaking power supply to the scanner 8, sends the power supply signal to the power supply unit 4 ([3]), and the power supply unit 4, upon receiving the power supply signal, supply the engine 12 with electric power ([4], Step S36). Being synchronous with power supply from the power supply unit 4 to the engine 12, the control unit 3 sends the operation control signal to the engine 12 ([5], Step S36).

The engine 12, upon being supplied with electric power from the power supply unit 4 and receiving the operation control signal from the control unit 3, utilizes the data read by the scanner 8 and starts printing (Step S37).

The engine 12, upon completing the printing on all the read data (i.e., YES at Step S37), or upon passing the last one of the copy paper sheets, sends the operation completion signal to the control unit 3 (Step S38). The control unit 3, upon receiving the operation completion signal, sends the power interruption signal to the power supply unit 4 ([8]), and the power supply unit 4, upon receiving the power interruption signal, interrupts power supply to the engine 12 ([9], Step S38).

After that, the control unit 3 sends the power interruption signal to the power supply unit 4 ([8]), and the power supply unit 4, upon receiving the power interruption signal, interrupts power supply to the control panel LCD 9*b* ([9], Step S39).

In this way, the procedure without features of the finisher under the copying machine mode is terminated.

Then, a procedure of the scanner mode (i.e., NO at Step S8 in FIG. 2) will be described.

Figure 4:
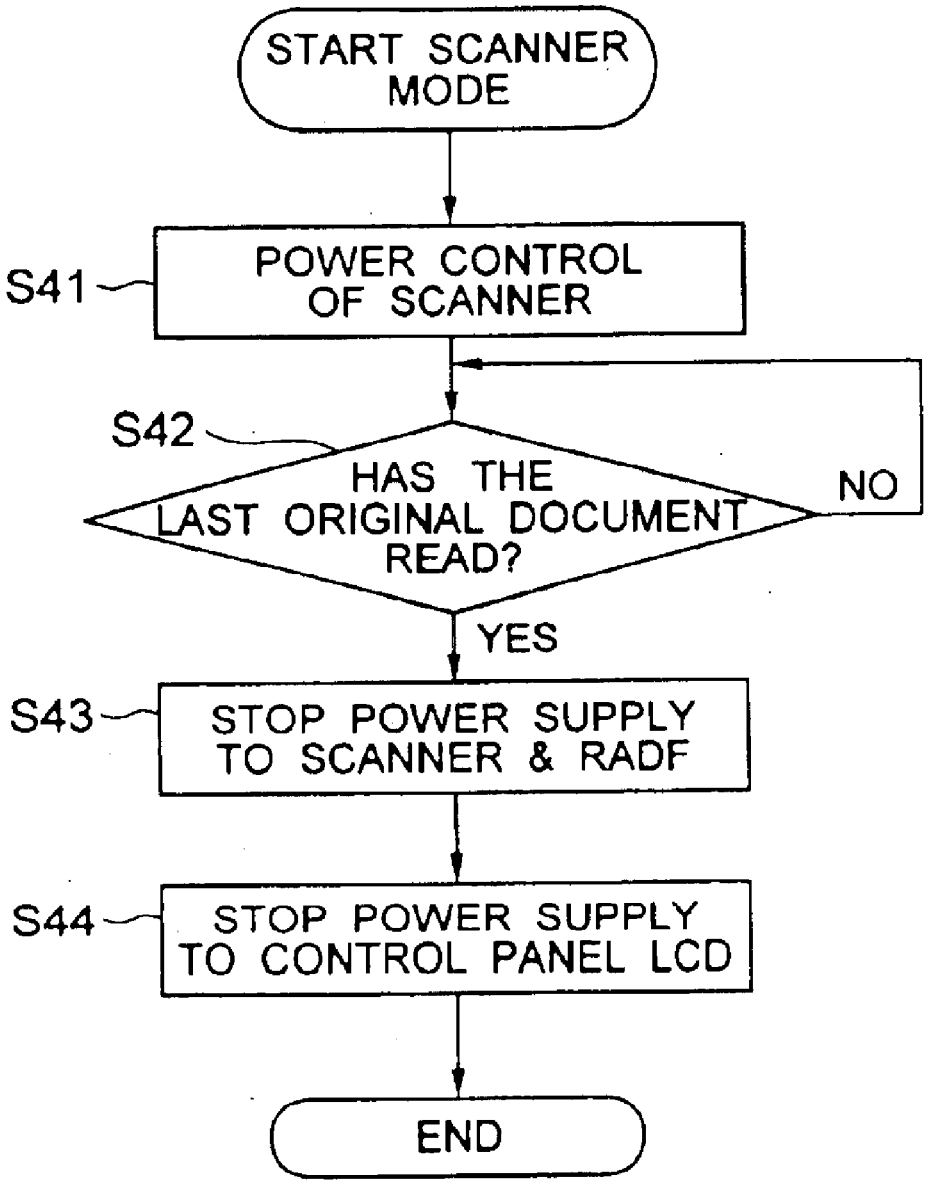
FIG. 4 is a flow chart illustrating succeeding steps (process of a scanner mode) to those in FIG. 2.

FIG. 4 is a flow chart illustrating the procedure under the scanner mode.

The control unit 3, which receives the input signal from the control panel input detector 9*a* and has a choice of the scanner mode, sends the power supply signal to the power source 4 ([3]), and the power supply unit 4, upon receiving the power supply signal, supplies the scanner 8 with power ([4], Step S41). Being synchronous with power supply from the power supply unit 4 to the scanner 8, the control unit 3 sends the operation control signal to the scanner 8 ([5], Step S41).

The scanner 8, upon being supplied with electric power from the power supply unit 4 and receiving the operation control signal from the control unit 3, starts reading the original documents (Step S42). The scanner 8 stores the read data in the memory not shown (Step S42).

The scanner 8, after reading all the original documents (i.e., YES at Step S42), sends the operation completion signal to the control unit 3 ([7], Step S43). The control unit 3, upon receiving the operation completion signal, sends the power interruption signal to the power supply unit 4 ([8]), and the power supply unit 4, upon receiving the power interruption signal, interrupts power supply to the scanner 8 ([9], Step S43). In reading the original documents sent from the RADF 6 (see Step S5 in FIG. 2), the power supply unit 4 also interrupts power supply to the RADF 6 ([8], [9], Step S43).

After that, the control unit 3 transmits the power interruption signal to the power supply unit 4 ([8]), and the power supply unit 4, upon receiving the power interruption signal, interrupts power supply to the control panel LCD 9*b* ([9], Step S44).

In this way, the procedure under the scanner mode is terminated.

Now, a procedure of the printer mode (i.e., NO at Step S7 in FIG. 2) will be described.

Figure 5:
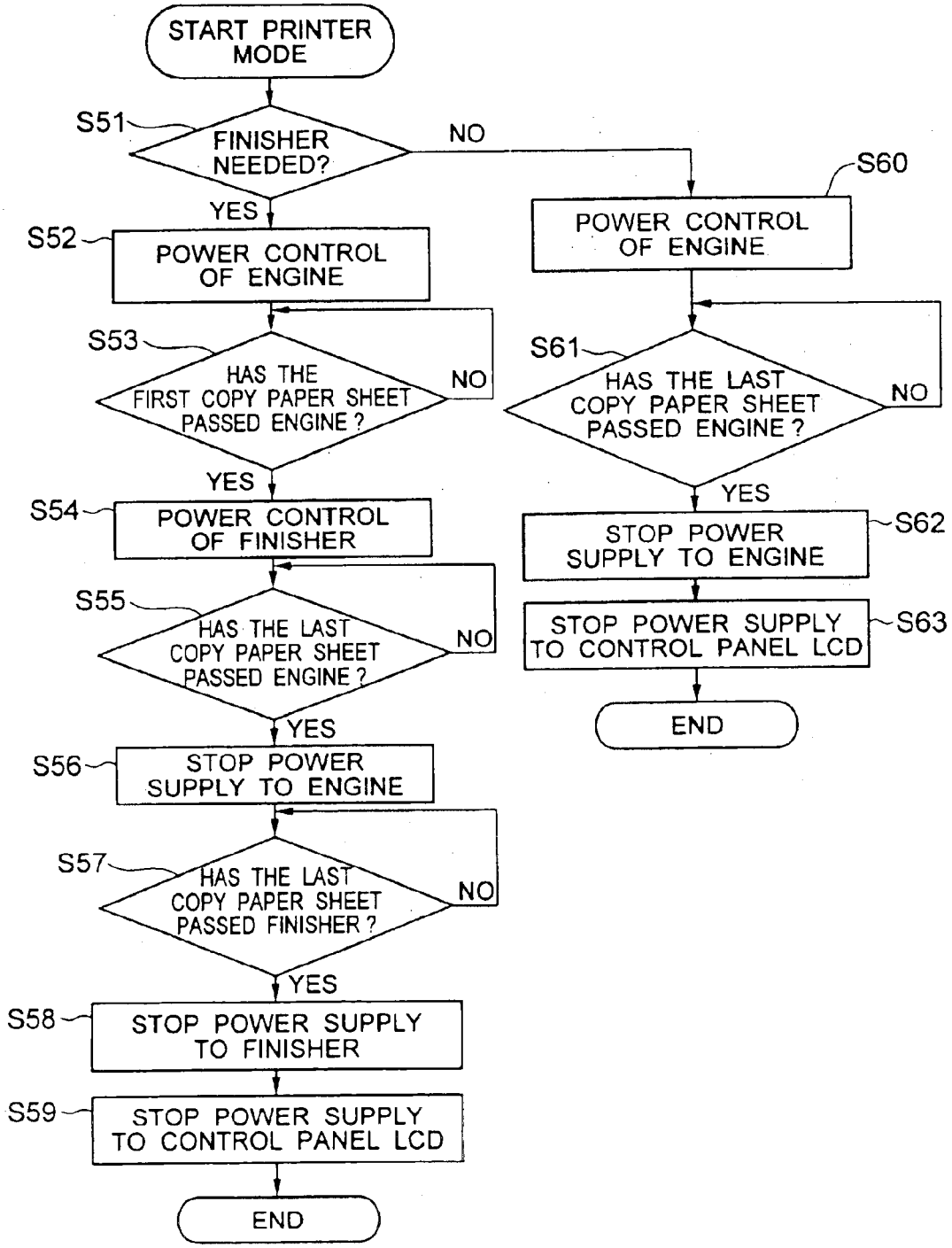
FIG. 5 is a flow chart illustrating succeeding steps (process of a printer mode) to those in FIG. 2.

FIG. 5 is a flow chart illustrating a procedure of the printer mode.

First, the control unit 3, which has a choice of the printer mode, receives the external signal and uses it to determine if some features of the finisher 13 are needed ([2], Step S51).

The control unit 3, when it determines that some features of the finisher 13 are needed (i.e., YES at Step S51), executes the following steps S52 to S59. The steps S52 to S59 are similar to the procedure with features of the finisher 13 under the copying machine mode (i.e., steps S22 to S32 in FIG. 3) except for the task on the scanner 8 (steps S22 to S24), and therefore, the detailed description is omitted.

On the contrary, when it determines that some features of the finisher 13 are needless (i.e., NO at Step S51), the control unit 3 executes the following steps S60 to S63. The steps S60 to S63 are also similar to the procedure without features of the finisher 13 under the copying machine mode (steps S33 to S39 in FIG. 3) except for the task on the scanner 8 (steps S33 to S35), and the detailed description is omitted, too.

Now described below will be an example of the image forming device to which the aforementioned control system is practically applied.

Figure 6:
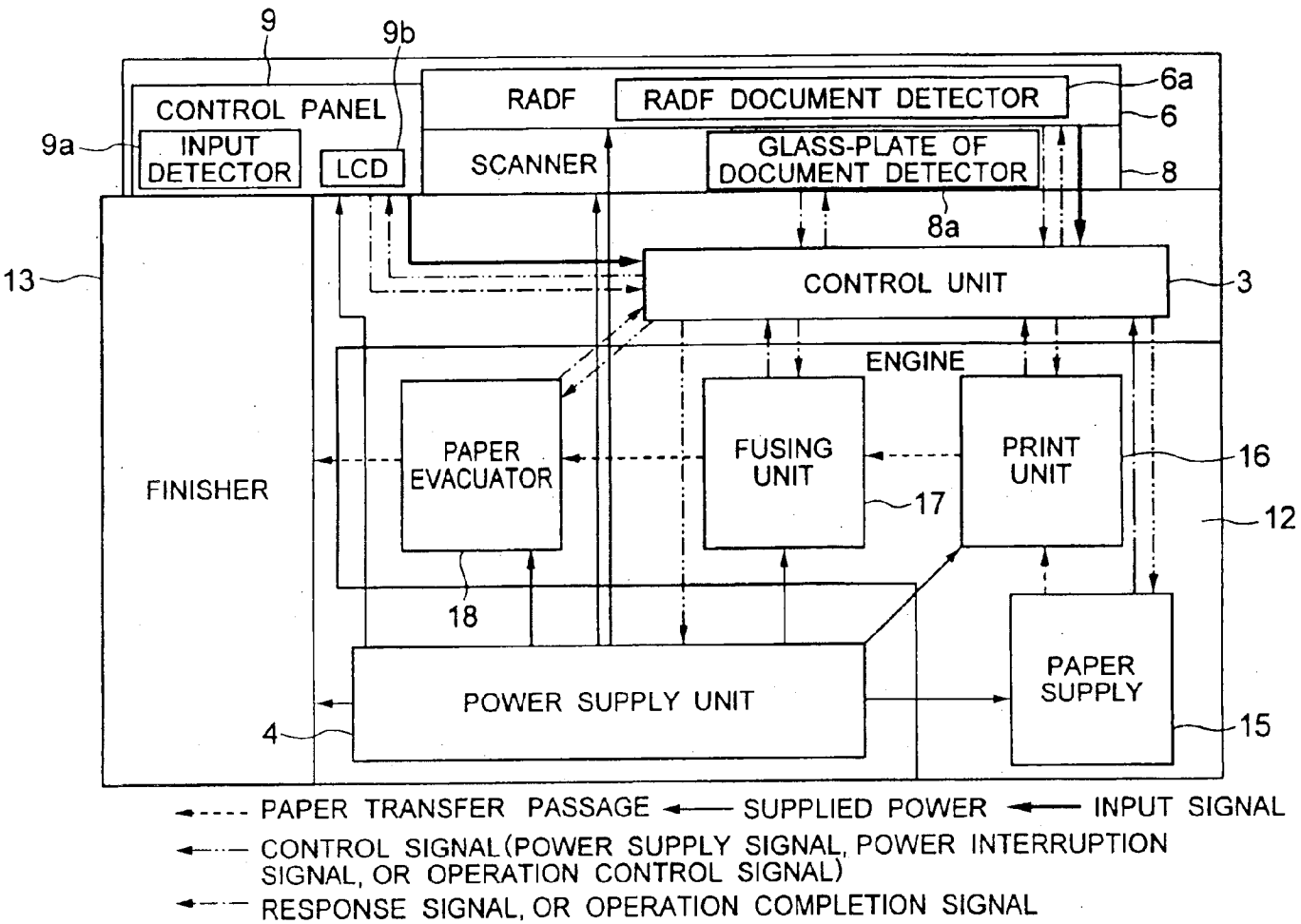
FIG. 6 is a block diagram showing a functional structure of the exemplary image forming device according to the present invention.

FIG. 6 is a block diagram showing a functional structure of the image forming device. In this figure, like reference numerals denote the similar parts and components to those illustrated in FIG. 1.

The image forming device is a versatile device in which a scanner, a facsimile, a printer, and other various features are built on the all-in-one basis.

As depicted in FIG. 6, an engine 12 or a counterpart of the engine 12 in FIG. 1 includes a paper supply 15, a print unit 16, a fusing unit 17, and a paper evacuator 18. It should be noted that the engine 12 may be varied in its structure depending upon a machine (M/C) that it belongs to. The paper supply 15 picks up a copy paper sheet from a paper box to send them to the print unit 16 located downstream. The print unit 16, which receives the copy paper sheet from the paper supply 15, reproduces an electrostatic latent image from the data read by the scanner 8, and then translates the electrostatic latent image with toner (developing agent) to create a toner image in the copy paper sheet. The fusing unit 17, receiving from the print unit 16 the copy paper sheet with the toner image, has it undergo heat and pressure treatment to fix the toner image in the copy paper sheet. The paper evacuator 18 receives from the fusing unit 17 the copy paper sheet with the toner image fixed therein and transfers it (after inverting it if required) to the finisher 13.

The remaining components are similar to those in FIG. 1.

For example, an input unit (a RADF document detector 6*a*, a glass-plate document detector 8*a*, and a control panel input detector 9*a*) determines if an original document exists in a RADF 6 or on a glass plate and detects entries of various settings.

The control unit 3 gives power and operation controls over the component units (e.g., RADF 6, control panel LCD 9, scanner 8, paper supply 15, print unit 16, fusing unit 17, paper evacuator 18, and finisher 13). Specifically, the control unit 3 produces a power supply signal and a power interruption signal to give instructions to supply power and interrupt power supply to those components, and it sends those signals to the power control unit 4 to give individual control over power supply to the components. The control unit 3 produces an operation control signal to give an instruction to activate the components and sends the signal to each component to control a commencement of the operation. The control unit 3, as mentioned later, receives response signals from the paper supply 15, the print unit 16, the fusing unit 17, and the paper evacuator 18 and uses those signals for timing adjustment of power supply to those components so as to reduce power consumption.

The power supply unit 4 receives the power supply signal and power interruption signal from the control unit 3, and in response to the signals, it starts or stops power supply to the components (e.g., the RADF 6, the control panel LCD 9, the scanner 8, the paper supply 15, the print unit 16, the fusing unit 17, the paper evacuator 18, and the finisher 13). The power supply 4 always supplies electrical power without intermission to the input unit (e.g., the RADF document detector 6*a*, the glass-plate document detector 8*a*, and the control panel input detector 9*a*) and to the control unit 3.

Various arrows in FIG. 6 respectively indicate directions of transfer of signals, supplied power, and paper sheets. For instance, thick solid line denotes an input signal transmitted from the input unit to the control unit 3; two-dot-slash line represents a control signal (a power supply signal, a power interruption signal, or an operation control signal) transferred from the control unit 3 to each component; one-dot-slash line indicates a response signal or an operation completion signal from each unit to the control unit 3. Normally fine solid line indicates power supply from the power supply unit 4 to each component. One exception is power supply to the input unit and the control unit 3 that is omitted in the figure. Broken line shows a passageway for transfer of paper sheets.

An operation of the image forming device having a system architecture as stated above will be described.

Figure 7:
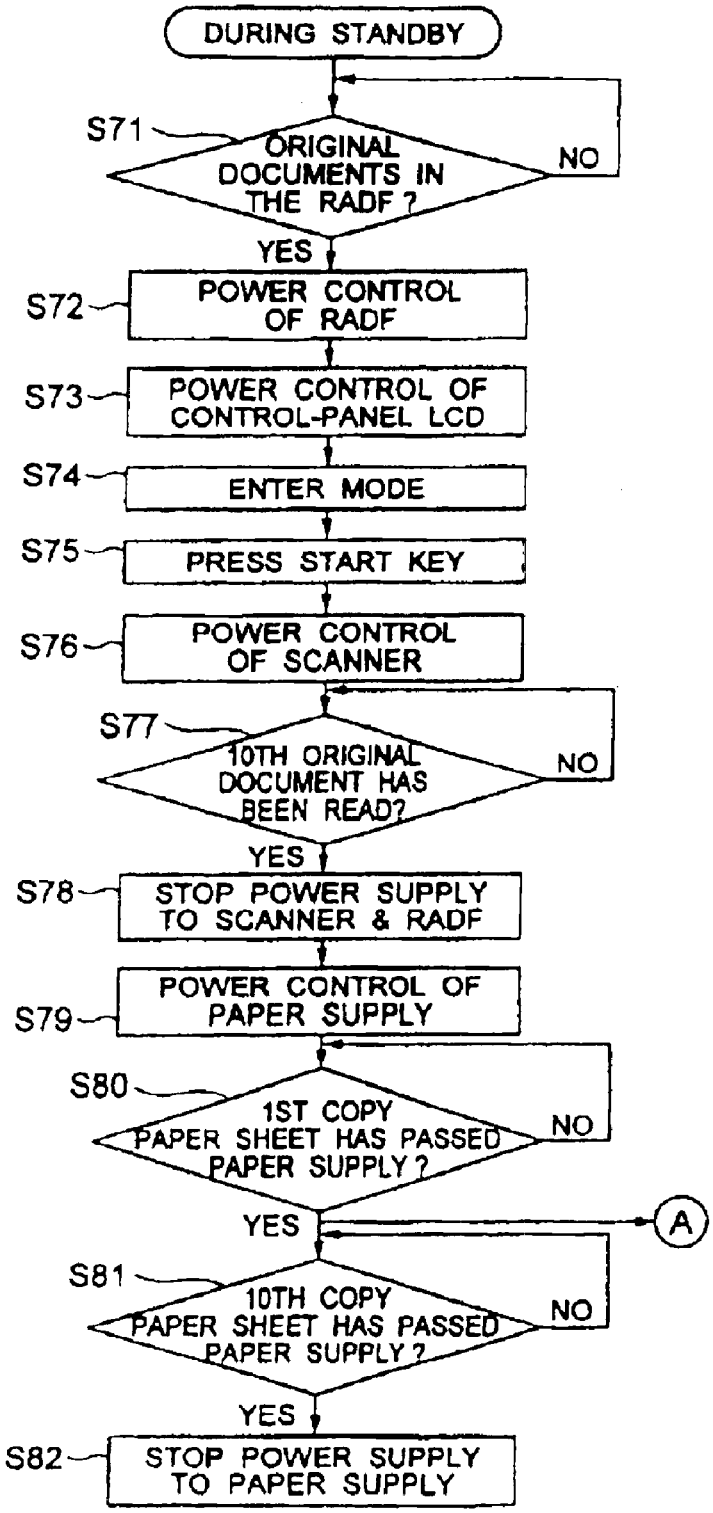
FIG. 7 is a flow chart illustrating stepwise operation of the image forming device.
Figure 8:
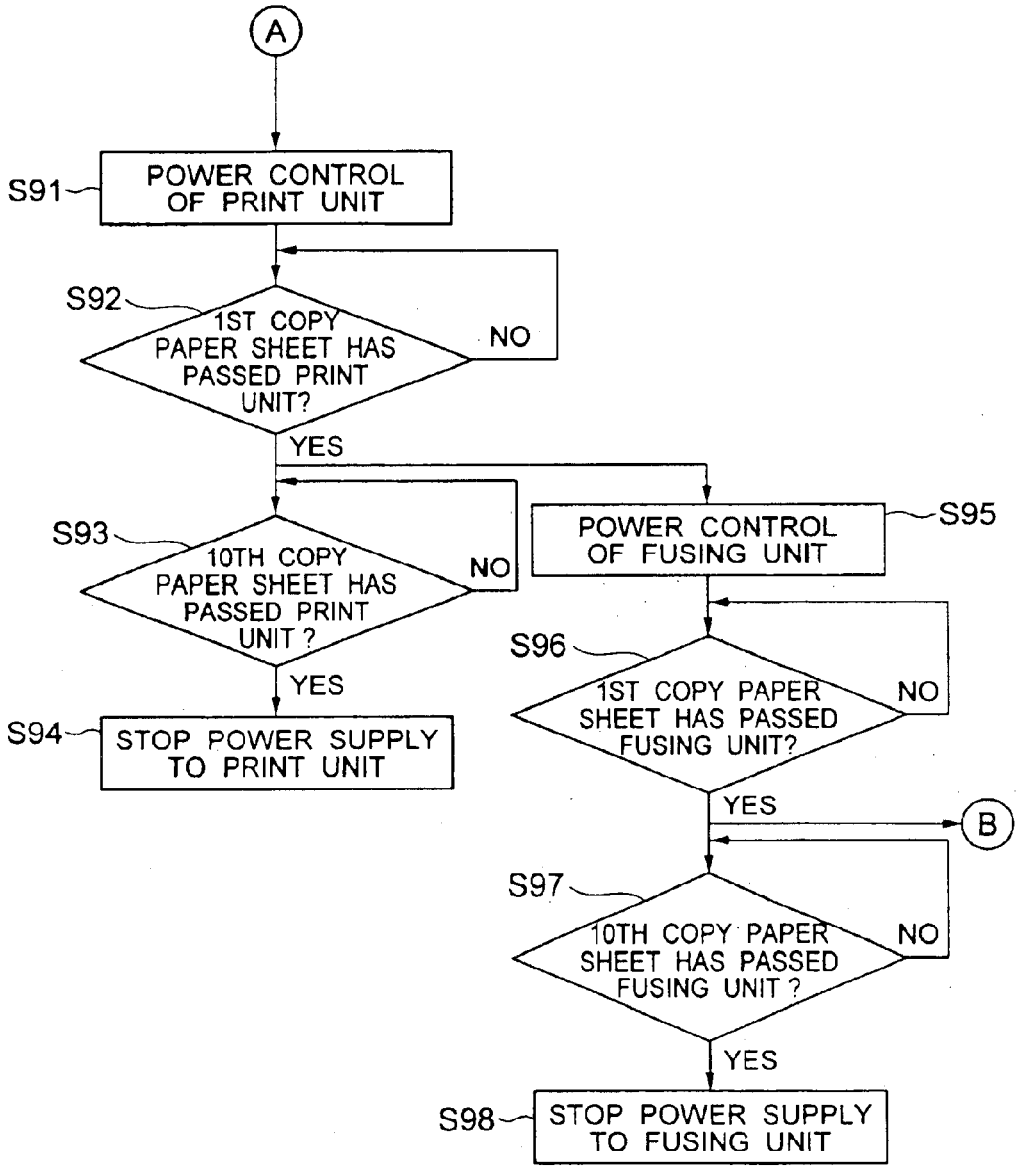
FIG. 8 is a flow chart illustrating succeeding steps to those in FIG. 7.
Figure 9:
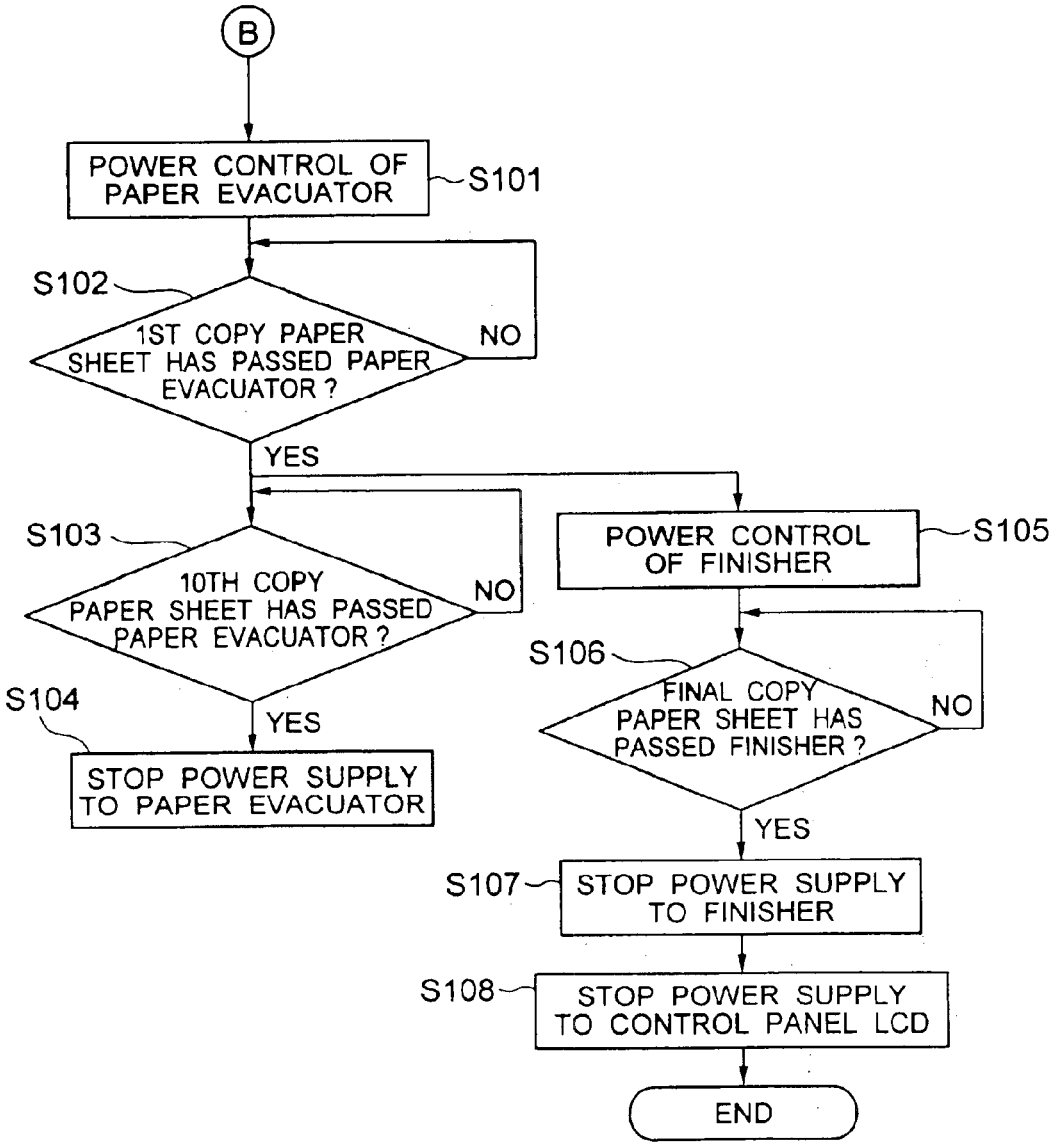
FIG. 9 is a flow chart illustrating succeeding steps to those in FIG. 8.

FIGS. 7 to 9 are flow charts illustrating the operation of the image forming device.

Disclosed below will be a case where ten of original documents are set in position in the RADF 6 to produce a single set of copies on the completion type copy basis. Such a procedure of "completion type copy" is a way of copying where once all the image data read from original images (from ten original documents) are stored in a memory, the stored image data is printed. The processed set of copies are evacuated into a tray installed in the finisher; that is, this is distinguished from a "temporary paper evacuation" into a built-in tray within the main body of the device. The operation of the image forming device will now be described into details.

First, a bunch of ten original documents are set in position in the RADF 6 by a user (Step S71). An input signal is transferred from the RADF document detector 6*a* to the control unit 3, and the control unit 3, upon receiving the input signal, determines that the original documents are placed in the RADF 6 (i.e., YES at Step S71). The control unit 3, after such a determination, sends the power supply signal to the power supply unit 4, and upon receipt of the signal, the power supply unit 4 supply the RADF 6 with electric power (Step S72).

The control unit 3, upon supplying power to the RADF 6, sends the power supply signal to the power supply unit 4, which in turn supplies power to the control panel LCD 9*b*

(Step S73). An indicator (not shown) of the control panel 9 is lit and ready for entries by the user (Step S73).

In this situation, the user uses the control panel 9 to enter some settings of the number of copies, a copying type, and a location of pickup like "1", "completion type copy", and "finisher", respectively (Step S74).

Then, the user press a start key button (not shown) provided in the main body of the device (Step S75).

When the start key button is depressed, input signals representing the entries of the settings (i.e., "1", "completion type copy", and "finisher") are transmitted from the control panel input detector 9*a* to the control unit 3 (Step S76). The control unit 3, upon receiving the input signals, sends the power supply signal to the power supply unit 4, which in turn supplies electric power to the scanner 8 (Step S76). Simultaneously, the control unit 3 sends the operation control signal instructing a commencement of the operation to the scanner 8 (Step S76).

The scanner 8, once it is supplied with power and receives the operation control signal, starts reading ten original documents sequentially fed from the RADF 6 onto the glass plate and storing image data (for 10 sheets) in the memory not shown (Step S77).

After reading the tenth original document (i.e., YES at Step S77), the scanner 8 sends the operation completion signal to the control unit 3 to report that all the original documents are read. The control unit 3, upon receiving the operation completion signal, sends the power interruption signal to the power supply unit 4, which in turn interrupts power supply to the scanner 8 and the RADF 6 (Step S78).

The control unit 3, once breaking power supply to the scanner 8 and the RADF 6, sends the power supply signal to the power supply unit 4, which in turn supplies the paper supply 15 with power (Step S79). Simultaneously, the control unit 4 sends the operation control signal to the paper supply 15 to instruct a commencement of the operation (Step S79).

The paper supply 15, once it is supplied with power and receives the operation control signal, starts picking up a paper sheet in a cassette not shown and feeding it to the print unit 16 (Step S80).

The paper supply 15, after feeding the top sheet of the paper stack to the print unit 16, or after passing the first one of copy paper sheets (i.e., YES at Step S80), sends the response signal to the control unit 3 to report it (Step S91 in FIG. 8). The control unit 3, upon receiving the response signal, sends the power supply signal to the power supply unit 4, which in turn supplies power to the print unit 16 (Step S91 in FIG. 8)

Eventually, the paper supply 15, after feeding and passing the tenth copy paper sheet (i.e., YES at Step S81 in FIG. 7), sends the operation completion signal to the control unit 3 to report completion of the task (Step S82). The control unit 3, upon receipt of the operation completion signal, sends the power interruption signal to the power supply unit 4, which in turn interrupts power supply to the paper supply 15 (Step S82).

The print unit 16, once supplied with power at Step S91 in FIG. 8, uses the image data stored in the memory and reproduces an unfused toner image in the copy paper sheet from the paper supply 15 (Step S92).

The print unit 16, after reproducing the toner image in the first copy paper sheet, or after passing the first copy paper sheet (i.e., YES at Step S92), sends the response signal to the control unit 3 to report it (Step S95). The control unit 3, upon receiving the response signal, sends the power supply signal to the power supply unit 4, which in turn supplies power to the fusing unit 17 (Step S95).

Finally, the print unit 16, after reproducing the toner image in the tenth copy paper sheet, or after passing the tenth copy paper sheet (i.e., YES at Step S93), sends the operation completion signal to the control unit 3 to report completion of the task (Step S94). The control unit 3, upon receiving the operation completion signal, sends the power interruption signal to the power supply unit 4, which in turn interrupts power supply to the print unit 16 (Step S94).

The fusing unit 17, once supplied with power at Step S95, has the copy paper sheet from the print unit 16 undergo heat and pressure treatment to fuse and fix the toner image in the sheet (Step S96).

The fusing unit 17, after fusing and fixing the toner image in the first copy paper sheet, or passing the first copy paper sheet (i.e., YES at Step S96), sends the response signal to the control unit 3 to report it (Step S101 in FIG. 9). The control unit 3, upon receipt of the response signal, sends the power supply signal to the power supply unit 4, which in turn supply power to the paper evacuator 18 (Step S101 in FIG. 9).

Eventually, the fusing unit 17, once fusing and fixing the toner image in the tenth copy paper sheet as indicated in Step S97 in FIG. 8, or after passing the tenth copy paper sheet (i.e., YES at Step S97), sends the operation completion signal to the control unit 3 to report completion of the task (Step S98). The control unit 3, upon receiving the operation completion signal, sends the power interruption signal to the power supply unit 4, which in turn interrupts power supply to the fusing unit 17 (Step S98).

The paper evacuator 18, once it is supplied with power at step S101 in FIG. 9, receives from the fusing unit 17 the copy paper sheet with the toner image fused and fixed therein and transfers it to the finisher (Step S102).

The paper evacuator 18, after transferring or passing the first copy paper sheet to the finisher 13 (i.e., YES at Step S102), sends the response signal to the control unit 3 to report it (Step S105). The control unit 3, upon receiving the response signal, transmits the power supply signal to the power supply unit 4, which in turn supplies power to the finisher 13 (Step S105).

Eventually, the paper evacuator 18, once transferring or passing the tenth copy paper sheet to the finisher 13 (i.e., YES at Step S103), sends the operation completion signal to the control unit 3 to report it (Step S104). The control unit 3, upon receiving the operation completion signal, sends the power interruption signal to the power supply unit 4, which in turn interrupts power supply to the paper evacuator 18 (Step S104).

The finisher 13, once supplied with power at Step S105, ejects the sheet from the paper evacuator into a tray not shown (Step S106).

The finisher 13, after ejecting the tenth (final) copy paper sheet into the tray, or once passing the tenth copy paper sheet (Step S106), sends the operation completion signal to the control unit 3 to report it (Step S107). The control unit, upon receiving the operation completion signal, sends the power interruption signal to the power supply unit 4, which in turn interrupts power supply to the finisher (Step S107).

The control unit 3, once breaking power supply to the finisher 13, sends the power interruption signal to the power supply unit 4, which in turn interrupts power supply to the control panel LCD 9*b* (Step S108).

In this way, the ten original documents are duplicated in a single set of copies.

In the aforementioned copying procedure, the user's entries are one set of copies by the completion type copy mode, but he or she can chose other modes (e.g., "more than one sets of copies" and "instantaneous copy without save") and attain power control of the functional units. In additional modes other than the copying, such as a scanner mode and a printer mode, similar procedures can attain power control over the device.

As has been described, in accordance with the present invention, the functional units are not supplied with power all at once, but instead, only some of them that should be activated are powered, and after the required tasks by the units are completed, power supply to those units are broken, thereby avoiding power consumption in any standby unit. Thus, the reduced power compared to the prior art is sufficient to obtain the required performance of the machine. Thus, the machine can attain energy saving operation superior to the prior art.

In the aforementioned power control method during the copying procedures (FIGS. 7 to 9), electric power is sequentially supplied on the upstream-units-first basis. As depicted in FIG. 6, the order of the units supplied with power is as follows: The RADF 6, the control panel LCD 9*b*, the scanner 8, the paper supply 15, the print unit 16, the fusing unit 17, the paper evacuator 18, and the finisher 13.

However, the fusing unit 17 and the scanner 8 (see FIG. 6) might spend time from the beginning of power supply till their activation (normal operation state). For example, there needs some time till the fusing unit 17 has its fusing roller heated to a certain level of temperature or till the scanner 8 has its emitted light stabilized sufficient to read original documents.

In these cases, the sequential power supply on the upstream-unit-first basis as mentioned above is unsatisfactory, and instead, it is desirable that the units of longer rise time are first supplied with power, and after these units are activated and get ready, the copying should be started. This will be described in more detail below. It is now assumed that the fusing unit 17 and the scanner 8 require some time from power supply till their respective activation, and that the former needs a longer rise time than the latter.

Figure 10:
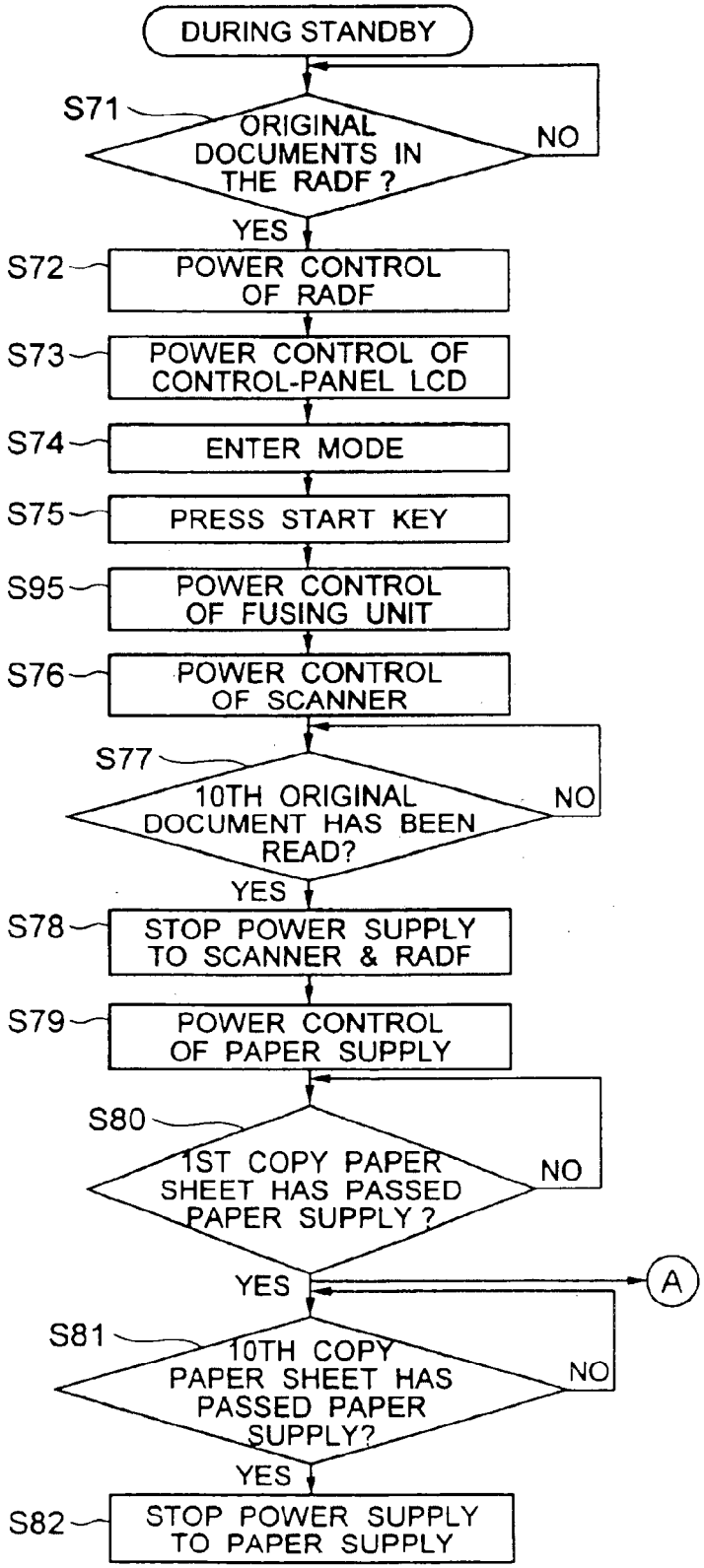
FIG. 10 is a partial modification of the flow chart in FIG. 7.

FIG. 10 depicts a partial modification of FIG. 7. For instance, a task of Step S95 in FIG. 9 (power control of the fusing unit) is interpolated between the steps S75 and S76 in FIG. 7. Such a modification will be detailed below.

As shown in FIG. 10, when a start key is pressed (Step S75) after steps S71 to S74 (see FIG. 7), first the task of power control of the fusing unit is executed (see step S95 in FIG. 8), and thereafter, the fusing unit is first supplied with power. Once the fusing unit 17 is completely activated, the task of power control of the scanner is executed as shown in FIG. 10 (Step S76), and the scanner 8 is powered. Otherwise, when the fusing unit 17 is ready not perfectly but to some predetermined extent, the power control of the scanner 8 may be commenced (Step S76). Thus, when power supply to the fusing unit 17 is completed not perfectly but at such a pace that it will have got ready before receiving a copy paper sheet, the next step may be executed. Subsequently, similar to the aforementioned exemplary procedures, the remaining steps S78 to S82 in FIG. 10 and the steps in FIGS. 8 and 9 are executed. However, since the step S95 in FIG. 8 (power control of the fusing unit) has already been performed (see step S95 in FIG. 10), the step should be omitted herein. In this way, earlier power supply to the more slowly activated units enables effective power supply control.

In such a case, after the start key is pressed, power supply to the fusing unit 17 and the scanner 11 is commenced (see steps S75, S95, and S76 in FIG. 10). Thus, when it takes a considerable period of time to activate the fusing unit 17 and the scanner 8, it spends an inadvertently long time from the pressing of the start key till a commencement of the printing. In order to cope with this disadvantage, the fusing unit 17 and the scanner 8 that take longer time to be activated may be adequately supplied with power in advance during the standby period of the device, so that they are ready not perfectly but to some predetermined extent. In this way, a response time of the fusing unit 17 and the scanner 8 after the start key is pressed can be shortened.

The aforementioned embodiment of the present invention may provide an alternative manner in use. For example, there may be options of two modes, namely, a normal mode and an energy saving mode, and in the normal mode, the prior art power control is used while, in the energy saving mode, the aforementioned exemplary power control according to the present invention is used.

What is claimed is:

1. An image forming device comprising:

a control unit producing power-on and power-off signals to control individual power supplied to functional units activated by supplied power, the power-on signal being an instruction to apply electric power to the functional units while the power-off signal is an instruction to interrupt power supplied to the functional units; and a power supply unit adapted to supply each functional unit with electric power upon receiving the power-on signal and interrupt power supplied to each functional unit upon receiving the power-off signal;

wherein the control unit produces an operation start signal to instruct actuation of each of the functional units and sends a respective operation start signal to each unit;

each of the functional units produces an operation completion signal to report completion of a task and sends the operation completion signal to the control unit; and the control unit produces the power-on signal to the power supply unit to supply each of the functional units with power before a predetermined time of actuation of the functional unit, and upon receipt of the operation completion signal from a respective of the functional units, the control unit produces the power-off signal to the power supply unit to terminate power supply to the respective functional unit.

2. An image forming device according to claim 1, wherein the control unit receives an operation state signal from each of the functional units located along a process line from upstream toward downstream, the operation state signal indicating a progression status of a respective task; and the control unit, if it determines that the operation state signal is received from one of the functional units located anywhere upstream, produces the power-on signal to the power supply unit to supply power to another of the functional units located downstream.

3. An image forming device according to claim 1, wherein the control unit refrains from supplying power to the functional units during standby of the device; and upon receipt of an input signal from an input unit of the standby device, the control unit produces the power-on signal to the power supply unit to supply power to specific one(s) of the functional units.

4. An image forming device according to claim 3, wherein the specific one of the functional units spends some time from the beginning of the supply of power until it gets ready for normal operation.

5. An image forming device according to claim 3, wherein the specific one of the functional units is activated first of all to start its task once the control unit receives the input signal from the input unit.

6. An image forming device according to claim 3, wherein the input unit is at least any one of an original document detector determining if original documents are set in position in a main body of the device, a control panel on which a user enters various settings, or an external apparatus transferring image signals from outside to the main body of the device.

7. An image forming device according to claim 3, wherein the control unit has the power supply unit keep some of the functional units supplied with power regardless of the standby status of the device, if the functional units spend time from the beginning of the supply of power until they get ready for their normal tasks.

* * * * *